US009829295B2

(12) United States Patent
Todd

(10) Patent No.: US 9,829,295 B2
(45) Date of Patent: Nov. 28, 2017

(54) AMMUNITION RELOADING SYSTEM

(71) Applicant: Jimmie Christopher Todd, Prairie Village, KS (US)

(72) Inventor: Jimmie Christopher Todd, Prairie Village, KS (US)

( * ) Notice: Subject to any disclaimer, the term of this patent is extended or adjusted under 35 U.S.C. 154(b) by 6 days.

(21) Appl. No.: 15/010,715

(22) Filed: Jan. 29, 2016

(65) Prior Publication Data

US 2017/0219326 A1 Aug. 3, 2017

(51) Int. Cl.
*G01F 11/10* (2006.01)
*F42B 33/02* (2006.01)

(52) U.S. Cl.
CPC ..... *F42B 33/0292* (2013.01); *F42B 33/0207* (2013.01)

(58) Field of Classification Search
CPC ..... G01G 11/08
USPC ... 222/77, 138, 311, 264, 268, 216, 21, 218, 222/220, 251, 302, 303, 304, 354, 355, 222/367, 438, 444, 564, 17, 18, 20, 52, 222/55–60, 63; 177/60, 61, 64, 66, 83, 177/84, 89, 100, 105, 106, 107, 108, 11, 177/112, 116, 120, 122
See application file for complete search history.

(56) References Cited

U.S. PATENT DOCUMENTS 260,656 A * 7/1882 Burrows ..... A01C 7/04 222/221
504,699 A * 9/1893 Bielefeldt ..... F42B 33/0292 86/20.15
763,308 A * 6/1904 Mitchell ..... G01F 11/24 111/153
792,918 A * 6/1905 Ohlendorf ..... A01K 61/85 221/186
932,944 A * 8/1909 Baker ..... G01G 11/08 222/461
1,343,802 A * 6/1920 Vest ..... A01C 7/00 222/141
1,884,365 A * 10/1932 Suppiger ..... B65B 1/363 221/265
2,661,876 A * 12/1953 Kindseth ..... B65B 1/34 177/116
2,690,856 A * 10/1954 Trondle ..... B21D 43/14 221/183
3,048,132 A * 8/1962 Morgan ..... A01C 7/04 111/153
3,291,233 A * 12/1966 Mayer ..... G01G 13/00 177/1
3,593,891 A * 7/1971 Kidd ..... B65G 53/4633 222/367
3,808,939 A 5/1974 Ashbrook
4,179,048 A * 12/1979 Pickett ..... A01C 7/02 222/242

(Continued)

*Primary Examiner* — Patrick M Buechner
*Assistant Examiner* — Michael J Melaragno
(74) *Attorney, Agent, or Firm* — Hall Estill Attorneys at Law; Tyler J. Mantooth

(57) ABSTRACT

An ammunition reloading system my have at least one local or remote controller connected to a volumetric dispenser and a kernel feeder. The controller can direct to flow of powder, such as gunpowder, to a vessel from the volumetric dispenser with a first granular resolution and from the kernel feeder with a second granular resolution where the second granular resolution is smaller than the first granular resolution.

19 Claims, 5 Drawing Sheets

(56) References Cited

U.S. PATENT DOCUMENTS 4,314,515 A * 2/1982 Jimenez ..... A01C 7/16 111/177
4,382,528 A * 5/1983 Gafford ..... A01C 7/18 221/265
4,498,783 A * 2/1985 Rudolph ..... B01F 15/0445 177/70
4,528,848 A * 7/1985 Hafner ..... G01F 11/24 110/101 CC
4,576,209 A * 3/1986 Eisenberg ..... B65B 1/363 141/1
4,667,503 A * 5/1987 Loos ..... G01G 19/24 366/141
4,696,356 A 9/1987 Ellion et al.
4,740,112 A * 4/1988 Muehlberger ..... B05B 7/1404 406/192
4,766,798 A * 8/1988 David ..... F42B 33/004 86/23
4,825,913 A 5/1989 Stott
4,880,142 A * 11/1989 Higuchi ..... G01G 11/086 177/114
4,920,853 A * 5/1990 Odom ..... F42B 33/0292 86/31
5,007,564 A * 4/1991 Beth ..... G01F 13/001 222/217
5,082,148 A 1/1992 Dunning
5,320,146 A * 6/1994 Stevie ..... B65B 1/363 141/1
5,419,071 A 5/1995 Fatica
5,466,894 A * 11/1995 Naef ..... B65B 1/22 141/83
5,497,907 A * 3/1996 Gmuer ..... G01G 13/20 222/227
5,501,366 A * 3/1996 Fiorido ..... A01C 7/046 111/77
5,738,249 A * 4/1998 Kikuchi ..... B01J 8/002 222/148
5,772,086 A * 6/1998 Krafft ..... G01F 11/261 222/438
5,775,532 A * 7/1998 Bullivant ..... G05D 7/0605 222/1
5,854,446 A * 12/1998 Tatsuoka ..... G01G 19/42 177/17
5,855,233 A * 1/1999 Bolelli ..... A61J 3/074 141/103
6,057,515 A * 5/2000 Murai ..... B65G 27/00 177/116
6,121,556 A * 9/2000 Cole ..... G01G 13/04 141/83
6,123,486 A * 9/2000 Wilms ..... B65D 88/68 222/237
6,681,550 B1 * 1/2004 Aylward ..... B65B 5/103 53/244
6,981,619 B2 * 1/2006 Moretto ..... B65D 90/582 141/192
7,032,787 B2 4/2006 Sherk, Jr. et al.
7,624,665 B1 * 12/2009 Lee ..... F42B 33/001 86/20.1
7,631,787 B1 * 12/2009 Lee ..... F42B 33/0207 222/288
7,713,043 B2 5/2010 Dopp et al.
7,857,166 B2 * 12/2010 Ryan ..... A23G 3/0085 118/306
7,950,423 B2 * 5/2011 Poole ..... B65B 1/12 141/18
8,047,408 B2 11/2011 Eaton et al.
8,367,946 B2 * 2/2013 Inauen ..... G01G 11/086 177/116
8,424,274 B2 * 4/2013 Aylward ..... B65B 35/26 53/235
8,523,014 B2 * 9/2013 Sollazzo ..... G01G 13/026 141/83
8,584,901 B2 * 11/2013 Dooley ..... A47J 31/401 222/129.4
9,562,803 B2 * 2/2017 Carter ..... G01G 13/022
2005/0247742 A1 * 11/2005 Livingston ..... G01F 11/46 222/444
2007/0187433 A1 * 8/2007 Webster ..... B65D 83/06 222/370
2007/0295755 A1 * 12/2007 Kinzie ..... G01F 11/24 222/239
2009/0302068 A1 * 12/2009 Schneider ..... G01F 11/12 222/344
2011/0061345 A1 * 3/2011 Cherukuri ..... A61J 3/00 53/473
2015/0246769 A1 * 9/2015 Pearlson ..... B65G 65/40 414/21

* cited by examiner

FIG. 4
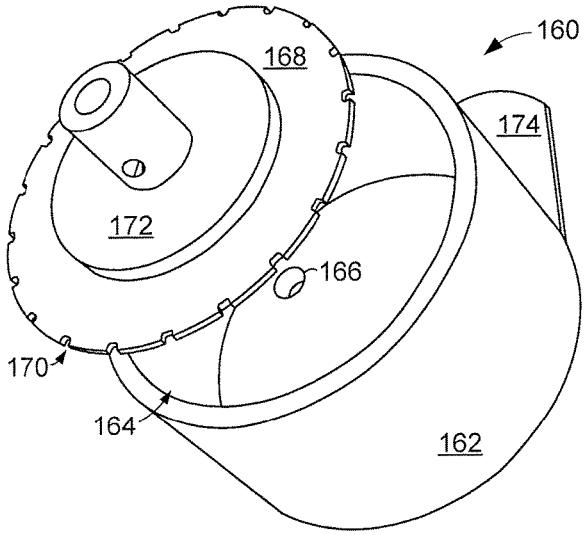
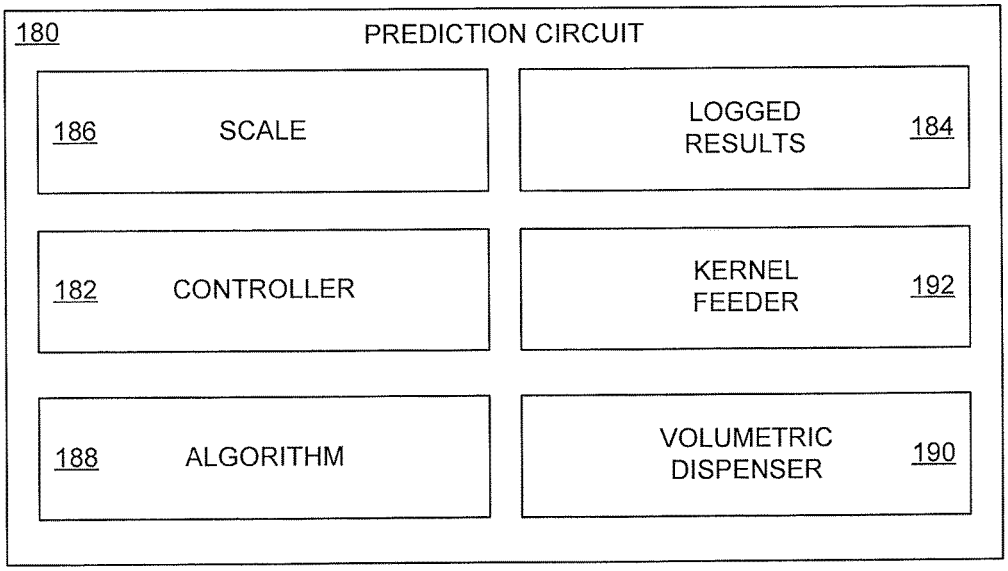
FIG. 5

AMMUNITION RELOADING SYSTEM

SUMMARY

An ammunition reloading system, in accordance with some embodiments, has a controller connected to a volumetric dispenser and a kernel feeder. The controller directs a flow of powder to a vessel from the volumetric dispenser with a first granular resolution and from the kernel feeder with a second granular resolution where the second granular resolution is smaller than the first granular resolution.

BRIEF DESCRIPTION OF THE DRAWINGS

FIG. 4 shows a cross-sectional line representation of a portion of an example kernel feeder constructed and operated in accordance with some embodiments.

FIG. 5 conveys a block representation of portions of an example ammunition reloading system operated in accordance with some embodiments.

DETAILED DESCRIPTION

Personal reloading of ammunition has increased in popularity recently. While the combination of casing, primer, projectile, and powder in a cartridge is straightforward, construction of a cartridge needs to be precise to ensure safety and reliability. It is noted that the current devices that allocate and dispense smokeless gunpowder can be inaccurate and difficult to properly operate. Hence, various embodiments are directed to an ammunition reloading system that intelligently allocates and dispenses a predetermined amount of gunpowder.

As a non-limiting example, a kernel feeder has a smaller granular resolution than a dispenser that are each connected to a controller that can utilize at least one sensor to determine an individual gunpowder size and deliver a precise amount of gunpowder. The ability to automatically determine the weight and size of a kernel of gunpowder allows the system to provide accurate gunpowder dispensing from the respective dispenser and kernel feeder that increases the performance of an ammunition reloading system. The automated ability of the controller further allows predictive determinations to be made that alters gunpowder dispensing characteristics to increase the efficiency and precision of a dispensed cartridge load.

Figure 1:
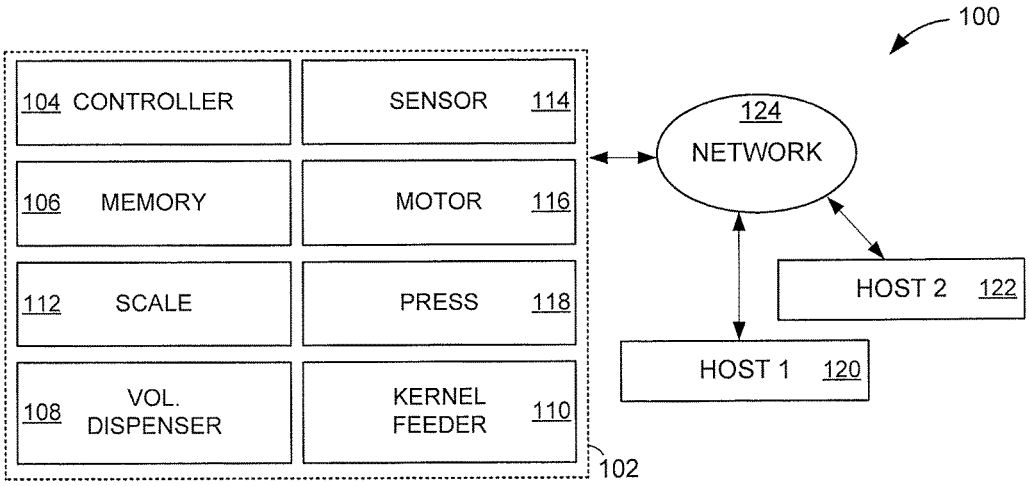
FIG. 1 is a block representation of a portion of example ammunition reloading system arranged in accordance with various embodiments.

While the various powder dispensing embodiments of the present disclosure can be employed in an unlimited variety of environments, such as pharmaceutical fabrication, assorted embodiments are utilized in the example ammunition reloading system 100 shown in FIG. 1. The ammunition reloading system 100 can have any number of separate, or interconnected, reloading assemblies 102 that serve to combine different components of a cartridge.

Although not limiting or required, a reloading assembly 102 can have a local controller 104, such as a microprocessor or application specific integrated circuit (ASIC), that can generate, direct, and execute data. The controller 104 can utilize one or more local memories 106, such as solid-state, rotating, and hybrid non-volatile memory, to store data associated with the equipment, setup, and operation of the reloading assembly 102. For example, the memory 106 may store software executed by the controller 104 and subsequently log data associated with the structure and operation of at least a volumetric dispenser (vol. dispenser) 108 and a kernel feeder 110.

It is noted that a volumetric dispenser 108 can be a diverse variety of powder storing equipment that selectively dispenses roughly a predetermined amount of product. A volumetric dispenser 108 and kernel feeder 110 can each, respectively, deliver powder via gravity, high pressure, and/or vacuum to one or more vessels positioned on a scale 112. The vessels may be cartridge casings or some other receptacle capable of containing powder. The scale 112 may be any weight measuring device that can be electronic, mechanical, or a combination of the two. It is contemplated that the scale is connected to the controller and has a resolution capable of discerning less than a grain of powder where a grain is a unit of measure equal to approximately 64.798 mg.

At least one sensor 114, such as an optical, acoustic, proximity, and environmental measurement device, can be continually, routinely, and randomly activated by the local controller 104 to detect various characteristics about the powder stored and delivered by the volumetric dispenser 108 and kernel feeder 110. That is, the controller 104 can employ one or more types of sensors 114 with similar or dissimilar tolerances and/or measurement capabilities to evaluate the environment in which the reloading assembly 102 is positioned, the size, weight, and/or density of powder stored in the respective volumetric dispenser 108 and kernel feeder 110, and the amount of powder being dispensed to the vessel(s) on the scale 112.

The reloading assembly 102 may have one or more motors 116 that are activated by the controller 104 to dispense a predetermined amount of powder. For instance, a motor 116 may open and close one or more valves in the volumetric dispenser 108 and/or kernel feeder 110 individually or collectively to dispense 0-1000 grains of powder at a time. In some embodiments, the scale 112 is incorporated into a press 118 that can assemble a cartridge. The press 118 may be single stage, turret, or progressive type devices that concurrently engage one or more cartridge casings. It is noted that the press 118 can be operated manually or automated in conjunction with the evaluation and delivery of powder by the controller 104 via the powder volumetric dispenser 108 and kernel feeder 110.

With the local controller 104 and memory 106, the reloading assembly 102 can operate independently and autonomously. However, the reloading assembly 102 may also be connected to one or more remote hosts 120 and 122 via a wired or wireless network 124 to allow external computing components access and control of the delivery of powder in the reloading assembly 102. For example, a first remote host 120 may be a remote server that stores data associated with powder size, density, and weights while a second remote host is a more powerful processor than the local controller 104 that analyzes data logged in the local memory 106 in order to predict the weight and size of an individual kernel of powder. The ability to utilize remote computing hosts allows the reloading assembly 102 to be more physically compact and efficient without sacrificing computing power.

Figure 2:
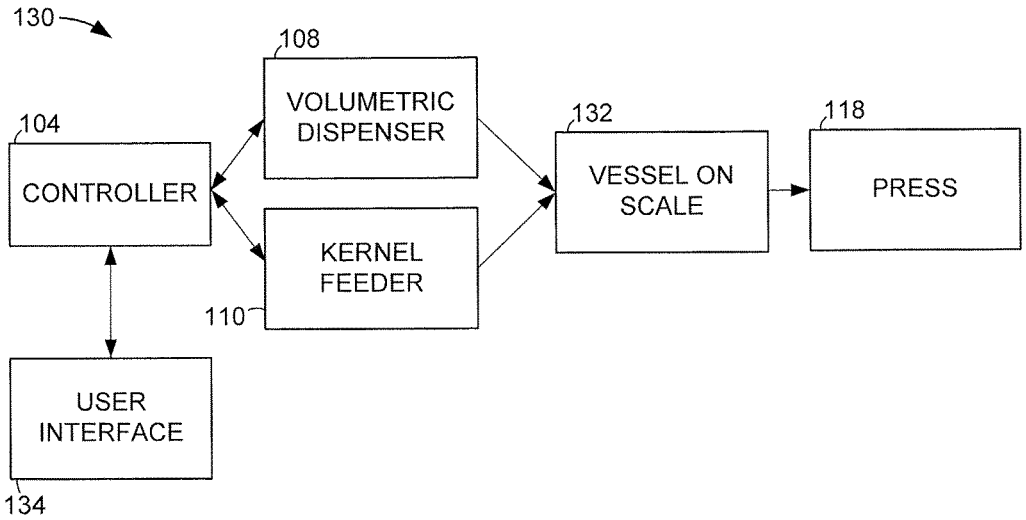
FIG. 2 displays a block representation of an example portion of the ammunition reloading system of FIG. 1.

FIG. 2 illustrates a block representation of an example flow of data through the reloading system 100 of FIG. 1 in accordance with some embodiments. Initially, a controller 104 selectively activates the volumetric dispenser 108 and kernel feeder 110 individually or concurrently to pass a predetermined amount of powder to a vessel 132 positioned on a scale. In some embodiments, a user interface 134 is utilized to input one or more operating parameters, such as desired powder amount, powder loaded into the volumetric dispenser 108 and kernel feeder 110, and desired speed of powder delivery.

It is noted that a gravity-fed volumetric dispenser 108 can be inaccurate due at least to the low weight of powder being delivered and the variance in a dispensing valve operation. Hence, assorted embodiments incorporate the kernel feeder 110 into the reloading system 100 to provide the ability to deliver individual kernels of powder to the vessel 132, which can complement the volumetric dispenser 108 to deliver a very precise amount of powder, such as having a tolerance of less than 1% of a 230 grain powder load.

As shown, the volumetric dispenser 108 and kernel feeder 110 can each receive data and commands from the controller 104 as well as generate data back to the controller 104. The generation of data by the volumetric dispenser 108 and kernel feeder 110 allows the ammunition reloading system 100 to be intelligent by evaluating environmental conditions, the condition of the powder stored in the system 100, and how powder is being delivered to the vessel 132. That is, the volumetric dispenser 108 and kernel feeder 110 can generate data, such as sensed powder and environmental conditions, as opposed to simply executing a command, like activating a valve. The generated data from the dispenser 108 and feeder 110 allow the controller 104 to log powder delivery characteristics to actually and predictively measure the size and weight of a kernel of powder, which corresponds with a precise amount of powder being delivered to the vessel 132.

Figure 3A:
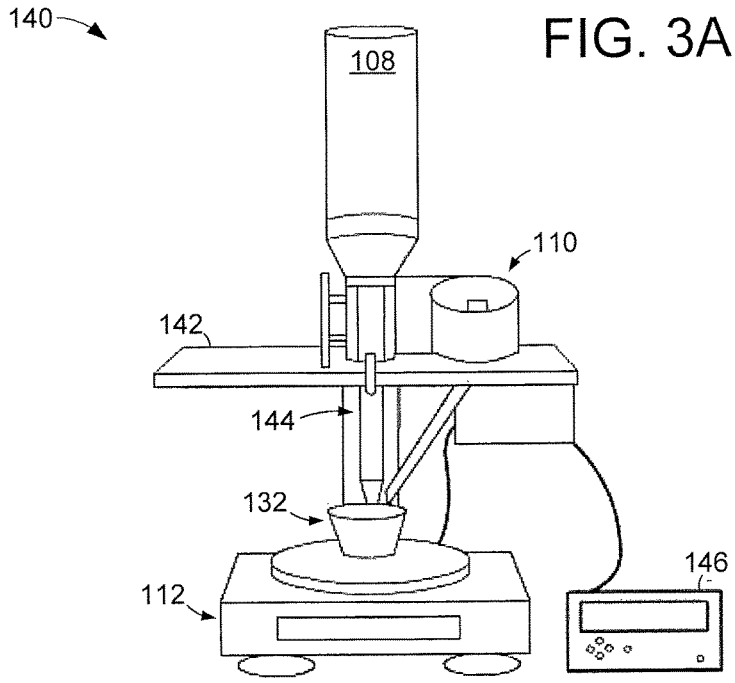
FIGS. 3A and 3B respectively illustrate line representations of portions of the example ammunition reloading system of FIG. 1.
Figure 3B:
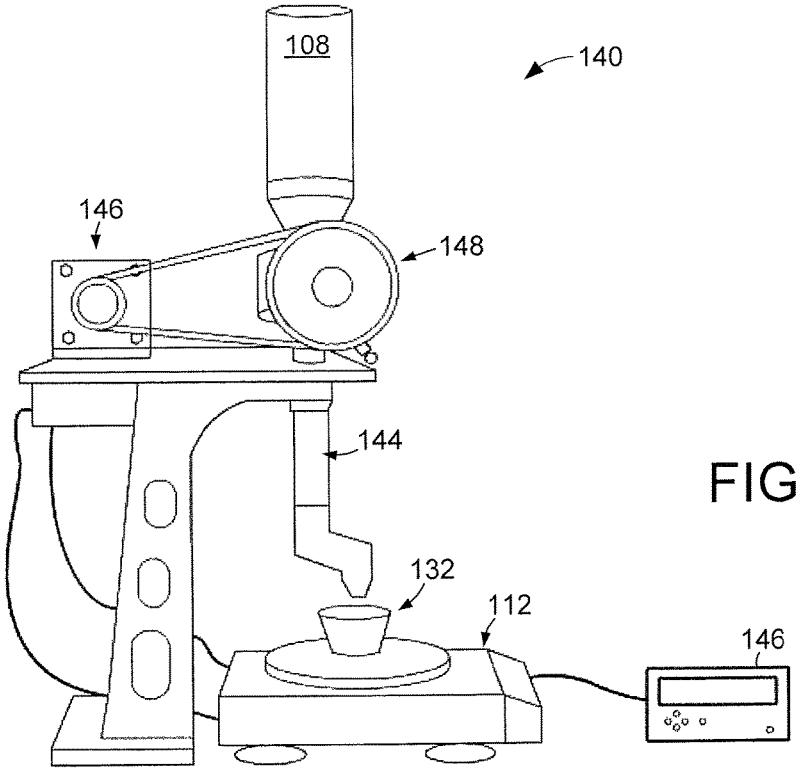

FIGS. 3A and 3B respectively convey line representations of portions of an example ammunition reloading system 140 arranged in accordance with various embodiments. In FIG. 3A, a volumetric dispenser 108 and kernel feeder 110 are positioned on a rigid base 142 with delivery tubes 144 respectively extending from the base to an open vessel 132 and a scale 112. It is noted that the delivery tubes 144 are separated and individually enclosed, but such configuration is not required as any arrangement can transport powder from the volumetric dispenser 108 and kernel feeder 110 to the vessel 132.

The volumetric dispenser 108, kernel feeder 110, and digital analytic balance scale 112 can each be connected to a user interface 146 that allows a user to monitor operation and input data, such as equipment and powder settings. It is contemplated that the user interface 146 houses a local processor and memory that communicates to a user via at least one screen employing a graphical user interface. The respective electrical connections to the user interface 146 may be achieved via one or more rs-232 connections, or other multi-wire connections, that provide concurrent data pathways conducive to reciprocal data transmission to and from the user interface 146.

In some embodiments, a local processor may be physically located in a housing 148 on the rigid base 142, which allows multiple different user interface 146 devices to concurrently connect to the various powder delivery components. For example, a wired connection between the computing components of the housing can concurrently operate with a wireless connection to a different computing device. The ability to concurrently connect a local reloading system controller with multiple different computing devices, such as the user interface 146 and a separate laptop computer, allows the system 140 to employ the computing capabilities of the external computing devices to supplement the local controller and memory.

FIG. 3B shows how the user interface 146 and local controller can be connected to a motor 150 that drives at least a valve 152 of the volumetric dispenser 108. The motor 150 may be any type of digital or analog propulsion device, such as a stepper motor, that articulates at a predetermined interval in relation to an input signal. The motor 150 can be physically connected to the volumetric dispenser 108 via any number of mechanisms, such as a chain, rope, pulley, shaft, or coupling. It is contemplated that a single motor 150 can individually activate the volumetric dispenser 108 or kernel dispenser 110 while other embodiments configure the system 140 with multiple separate motors 150 that are each controlled by a local controller to sequentially or concurrently deliver powder from the volumetric dispenser 108 and kernel feeder 110.

FIG. 4 is a perspective view line representation of a portion of an example kernel feeder 160 that may be employed in the ammunition reloading system 100 of FIG. 1. The kernel feeder 160 is not limited to the configuration shown in FIG. 6, but can have an external casing 162 having a recess 164 and at least one aperture 166 continuously extending through the casing 162. The recess 164 can be arranged so that one or more wheels 168 can reside within the casing 162 along with a volume of powder.

The wheel 168 has a plurality of notches 170 that are configured with a shape conducive to moving small amounts of powder within the casing 162. That is, the wheel 168 has area(s) of removed material that are designed with linear and/or curvilinear surfaces that translate a predetermined amount of powder, such as less than 1 grain of powder, as the wheel 168 rotates about a central spindle 172. In some embodiments, the wheel 168 has differently shaped notches 170 that allow predetermined amounts of powder to escape the casing 162 the aperture 166.

Although not required, the kernel feeder 160 may have one or more doors 174 that can be selectively articulated to change the size of the aperture 166. For instance, a door 174 can be rotated over the aperture 166 to ensure that an individual kernel of powder escapes the casing 162 regardless of the size of the kernels of a powder. Hence, the door 174 can operate in conjunction with a local system controller to manipulate what size of particle can pass from the casing 162 to a vessel, such as vessel 132.

It can be appreciated that the combination of a relatively large volume delivery mechanism, such as the volumetric dispenser that provides multiple grains of powder at a time, along with a relatively small volume delivery mechanism, like the kernel feeder, allows for precise dispensing of a predetermined amount of powder. Accordingly, the term "granular resolution" is meant as the smallest volume of powder that can reasonably be delivered by a device. For example, the volumetric dispenser cannot reasonably deliver a single kernel of powder reliably due to the configuration of the dispenser's valve. Furthermore, the kernel feeder would not reasonably be used to provide a grain or more of powder due to the relatively slow and inefficient wheel and casing configuration that provides kernel-by-kernel resolution. Hence, the combination of large and small granular resolution devices provides an optimized balance between speed of powder delivery and accuracy.

With the combination of large and small granular resolution devices, the reloading system controller can intelligently log performance and predict changes in powder delivery to ensure accurate powder dispensing regardless of the environmental, structural, and operational conditions experienced by the system. FIG. 5 is a block representation of an example prediction circuit 180 that acts in cooperation with various reloading system components to determine the size of an individual kernel of powder, which can be characterized as a "kernel value."

The prediction circuit 180 can reside wholly, or partially, on a circuit board with the local system controller, but such configuration is not required. The prediction circuit 180 may employ an independent controller 182 or may utilize the system controller, such as controller 104, to log at least one previous system result 184 from a scale 186 in a local memory. The controller 182 can further execute software that includes a prediction algorithm 188 to determine the physical size and weight of a kernel of powder from the logged results 184. The predicted kernel size and weight can then allow the controller 182 to alter the operation of the volumetric dispenser 190 and kernel feeder 192 to precisely deliver a specified amount of gunpowder repeatedly.

Figure 6:
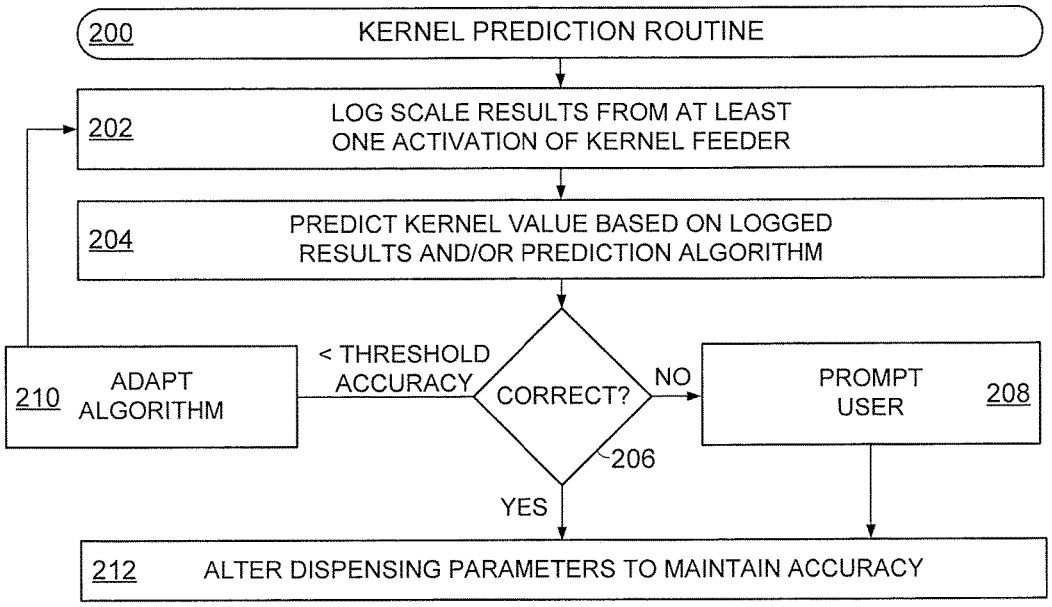
FIG. 6 is a block representation of an example prediction circuit capable of being utilized in the ammunition reloading system of FIG. 1.

While not limited, the prediction circuit 180 can perform the kernel prediction routine 200 shown in FIG. 6 by initially logging scale results from at least one activation of the kernel feeder in step 202. Such activation may be conducted as part of system calibration or may be part of actual system delivery of powder for a cartridge. The logged results from step 202 are then used to predict a kernel value in step 204 as a function of one or more prediction algorithms, such as algorithm 188 of FIG. 5. The predicted kernel value can provide a kernel size, weight, density, and risk of sticking to other kernels as a product of collected sensor data, such as humidity, temperature, optical analysis, acoustic evaluation, and the resistance of the kernel feeder wheel during operation.

The predicted kernel value allows routine 200 to proceed to decision 206 where powder delivery performance is evaluated to determine if the predicted kernel value is correct. That is, decision 206 can deliver a single kernel of powder and determine at least the size, weight, and density of the kernel based on quantitative analysis. It is contemplated that the evaluation of a sample kernel for decision 206 can involve passing a kernel through one or more testing components, such as a filter, to confirm or reject the predicted kernel value as being with a predetermined prediction tolerance, which can be selected by a user, such as <1 mg.

If the predicted kernel value is not correct and is outside the selected tolerance, step 208 prompts the user to conduct at least one calibration routine. In the event the predicted kernel value is close to the selected tolerance, the routine 200 adapts the prediction algorithm in step 210 before returning to step 202. The adaptations for the algorithm may involve activating different sensors, ignoring at least one sensed parameter, and using model kernel data based on user-inputted powder information. Once decision 206 determines the predicted kernel value is accurate and within the selected tolerance, step 212 alters dispensing parameters, such as the speed of the kernel feeder wheels rotating or the feeder door position, to dispense a single kernel at a time to maintain an overall load tolerance for delivered powder, such as <2 mg.

Figure 7:
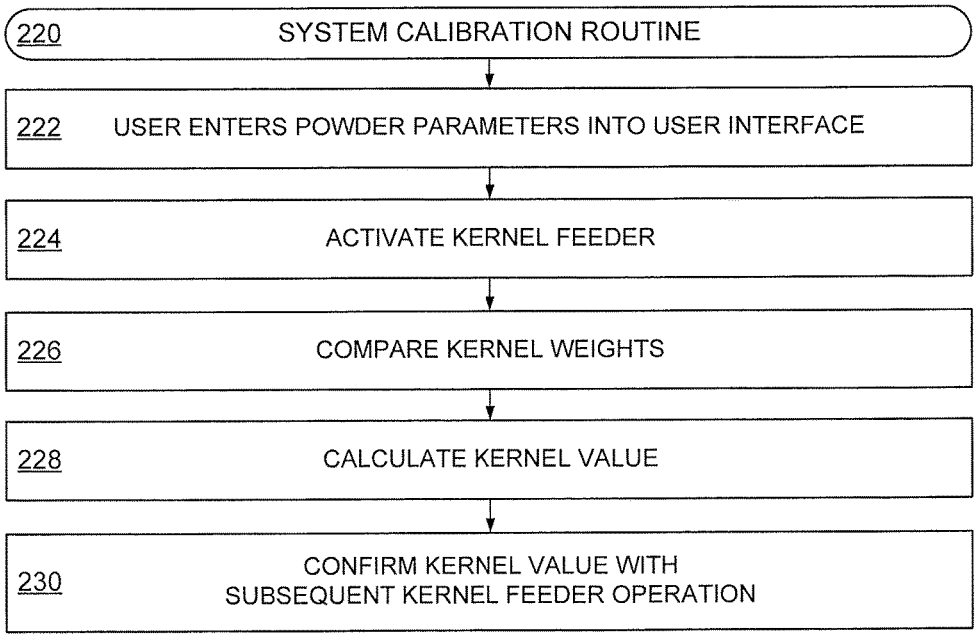
FIG. 7 displays a flowchart of an example prediction routine that may be carried out by the example ammunition reloading system of FIG. 1.

FIG. 7 displays an example reloading system calibration routine 220 that can be carried out independently, or concurrently, with the prediction routine 200 of FIG. 6 in accordance with various embodiments. The system calibration routine 220 can begin with a user entering at least one powder parameter into a user interface, such as interface 134 of FIG. 2. An example powder parameter is the trade name of a powder, such as Winchester Brand 232 powder, which can be correlated with model data by a system controller to find powder weight, size, and density. It is contemplated that the user can enter no powder data into the system, which can correspond with the system using default model data before proceeding to step 224 where the kernel feeder is activated.

By comparing kernel weights in step 226, the system controller can assess how many kernels of powder are being dispensed by the kernel feeder in response to an input signal. It is contemplated that step 226 is conducted in conjunction with at least one prediction step of routine 200 to determine if the powder parameters used in step 220 are within acceptable parameters. Through one or more comparisons of dispensed kernels in step 226, a kernel value can be calculated in step 228 as a function of the environmental and operational characteristics at the time. That is, the kernel value calculated in step 228 may be correlated by the system controller to the environmental and operational conditions during the calibration routine 220. Hence, a calibrated kernel value from step 228 can be associated with more than just the powder loaded into the kernel feeder, which increases the precision and efficiency of the system reaching a selected powder load amount.

At the conclusion of step 228, the calculated kernel value is confirmed in step 230 with subsequent kernel feeder operation. As such, the system can continuously, routinely, and/or sporadically calibrate the operating parameters of the kernel feeder, such as wheel rotation speed and door positon relative to the casing aperture, to ensure a single kernel of powder is delivered in response to an input signal from the controller. It is noted that any step of the calibration routine 220 can be conducted before, during, and after the reloading system is delivering powder to cartridge casings. In other words, the system calibration routine 220 does not require the reloading system to be taken offline before calculating a kernel value that corresponds with the environmental and operational characteristics of the reloading system.

Figure 8:
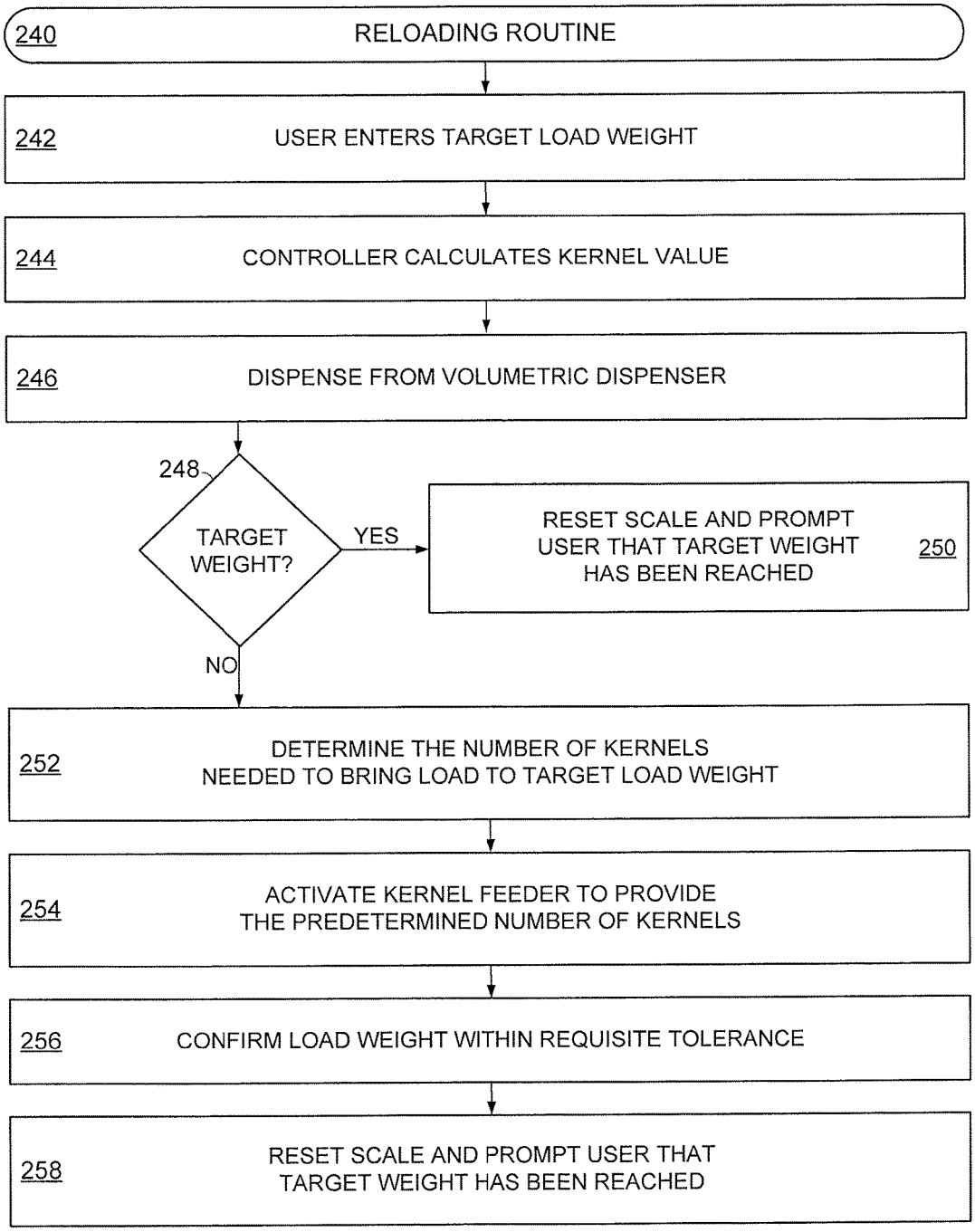
FIG. 8 provides an example operational diagram capable of being utilized by the example ammunition reloading system of FIG. 1.

It is contemplated that the routines 200 and 220 can be executed at any time. In some embodiments, each routine 200 and 220 is performed prior to, or during, the example reloading routine 240 of FIG. 8, but such sequence is not required or limiting. In the reloading routine 240, a user initially enters a target load weight in step 242, such as 230 grains. A local controller proceeds to calculate a predicted and/or actual kernel value in step 244 before activating the volumetric dispenser in step 246.

It is possible that the volumetric dispenser provides a load of powder close enough to the target load weight to be within acceptable tolerances. Decision 248 evaluates if the volumetric dispenser achieved the target weight despite having a relatively high granular resolution. If so, step 250 resets the system scale and the target load is transitioned to the next step of cartridge assembly. However, if the volumetric dispenser did not reach the target load weight, step 252 then determines the number of kernels needed to bring the target load within the acceptable tolerance by referring to the kernel value calculated in step 244.

The number of individual kernels from step 252 are delivered in step 254 by activating the kernel feeder at least once. The deposition of the individual kernels from step 254 is confirmed, along with the overall target load weight, in step 256. In the instance where step 256 results in a too much powder being present, the routine 240 can prompt the user an error has occurred and to discard the target load. When step 256 results in a correct load weight within acceptable tolerances, the routine resets the scale in step 258 and prompts the user of a completed load.

It is noted that the various aspects of routines 200, 220, and 240 are merely exemplary and no portion is required. As such, any steps and decisions can be changed or removed just as any number of steps and decisions can be added. For example, the reloading routine 240 may further incorporate at least one step that fills a casing with the target powder load prior to pressing a projectile into the casing.

Through the various embodiments of the present disclosure, precise amounts of gunpowder can be quickly delivered. The combination of different large and small granular resolution powder delivery components allows for efficient dispensing of a majority of a target load before the kernel feeder provides individual kernels to bring the target load to a final weight. The ability to utilize calibration and predictive intelligence with the respective volumetric dispenser and kernel feeder further increases the efficiency and precision of powder delivery by adapting to assessed environmental and operational conditions at the time of powder delivery.

While the embodiments herein have been directed to gunpowder delivery and ammunition fabrication, it will be appreciated that the various embodiments can readily be utilized in any number of other applications, such as pharmaceutical and laboratory powder delivery. It is to be understood that even though numerous characteristics of various embodiments of the present disclosure have been set forth in the foregoing description, together with details of the structure and function of various embodiments, this detailed description is illustrative only, and changes may be made in detail, especially in matters of structure and arrangements of parts within the principles of the present technology to the full extent indicated by the broad general meaning of the terms in which the appended claims are expressed. For example, the particular elements may vary depending on the particular application without departing from the spirit and scope of the present disclosure.

What is claimed is:

1. An apparatus comprising a volumetric dispenser and a kernel feeder each connected to a controller and configured to feed powder to a vessel, the volumetric dispenser having a larger granular resolution than the kernel feeder, the volumetric dispenser having a first granular resolution and the kernel feeder has a second granular resolution, the second granular resolution determined by a prediction circuit of the controller.

2. The apparatus of claim 1, wherein the volumetric dispenser has a valve mechanism to dispense the first granular resolution.

3. The apparatus of claim 1, wherein the kernel feeder has a rotating wheel with at least one notch to dispense the second granular resolution.

4. The apparatus of claim 1, wherein the kernel feeder has an aperture communicating with a door to dispense the second granular resolution.

5. The apparatus of claim 1, wherein the volumetric dispenser and kernel feeder are each attached to a common rigid base.

6. A method comprising:

connecting a controller to a volumetric dispenser and a kernel feeder;

feeding powder to a vessel from the volumetric dispenser, the volumetric dispenser having a granular resolution greater than a kernel of powder; and a kernel feeder connected to the controller and configured to feed powder to a vessel, the kernel feeder having a granular resolution of a single kernel of powder dispensed via a door adjusted by the kernel feeder.

7. The method of claim 6, wherein the volumetric dispenser operates independently from the kernel feeder.

8. The method of claim 6, wherein the door reduces a size of an aperture to dispense the single kernel of powder at a time.

9. The method of claim 8, wherein the aperture is larger than the single kernel of powder and the door moves independent of the aperture.

10. The method of claim 8, wherein the kernel feeder dispenses only the single kernel of powder to the vessel.

11. A method comprising:

dispensing a first volume of powder to a vessel via a volumetric dispenser having a first granular resolution as directed by a controller; and feeding a second volume of powder to the vessel via a kernel feeder having a second granular resolution as directed by the controller, the second granular resolution determined by a prediction circuit connected to the controller.

12. The method of claim 11, wherein the prediction circuit predicts a size of a single kernel of powder.

13. The method of claim 12, wherein the size comprises a weight of the single kernel of powder.

14. The method of claim 11, wherein the prediction circuit stores at least one prediction algorithm in local memory.

15. The method of claim 11, wherein the prediction circuit logs powder characteristics during a calibration routine.

16. The method of claim 15, wherein the calibration routine compares predicted and measured powder weights.

17. The method of claim 11, wherein the prediction circuit updates the at least one prediction algorithm with one or more new measured powder weight.

18. The method of claim 17, wherein the update alters the at least one prediction algorithm in response to the one or more new measured powder weight.

19. The method of claim 11, wherein the second granular resolution is a single kernel of powder and the controller dispenses a predetermined weight of powder to the vessel within a grain of the predetermined weight.

* * * * *